United States Patent [19]

Wallo

[11] Patent Number: 4,572,379

[45] Date of Patent: Feb. 25, 1986

[54] LARGE CAPACITY DISPLAY STAND FOR PHOTOS AND THE LIKE

[75] Inventor: William H. Wallo, Clearwater, Fla.

[73] Assignee: W. H. Wallo & Associates, Inc., Clearwater, Fla.

[21] Appl. No.: 624,347

[22] Filed: Jun. 25, 1984

[51] Int. Cl.[4] ..... A47F 7/00; G09F 19/00

[52] U.S. Cl. ..... 211/57.1; 40/530; 211/50; 211/181; D19/76

[58] Field of Search ..... 40/383, 530, 379, 382, 40/119; 211/50, 57.1, 45, 59.1, 181; D19/76

[56] References Cited

U.S. PATENT DOCUMENTS

| | | | |
|---|---|---|---|
| D. 235,238 | 6/1975 | Braverman | D6/85 |
| D. 248,964 | 8/1978 | Kizlauskas | D19/76 |
| 2,589,383 | 3/1952 | Holt | 40/379 |
| 3,218,743 | 11/1965 | Shneider | 40/72 |
| 4,222,190 | 9/1980 | Solomon | 40/530 |
| 4,365,434 | 12/1982 | Doyel | 40/530 |
| 4,399,626 | 8/1983 | Braverman et al. | 40/530 |

*Primary Examiner*—Robert W. Gibson, Jr.

[57] ABSTRACT

A large capacity display stand for sleeves carrying graphic material, the stand being especially adapted to be constructed as a wire-form structure providing a frame having sleeve suspending arms with transition guides for manipulation of the sleeves into and out of generally upright viewing position on supporting bar fingers superposed in spaced relation to the arms, and the upright sleeves resting against a combination handle and sleeve rest.

19 Claims, 5 Drawing Figures

LARGE CAPACITY DISPLAY STAND FOR PHOTOS AND THE LIKE

The present invention relates to display stands, and is more particularly concerned with such stands especially suitable for storage and display of graphic material such as photographs and the like carried in conventional photo sleeves (translucent two sided windows made from clear plastic film).

Stands of this type are useful for handling flat card like objects such as photos, record cards, display or information sheets, and the like, for business or pleasure purposes. For example, sales persons may find such stands useful in displaying pictures and other information concerning products offered for sale. For pleasure purposes, such stands are useful for conveniently storing and displaying photographs which may be viewed sequentially by manipulation of the photoholders or sleeves.

Stands for displaying photographs and the like have been heretofore proposed as for example in U.S. Pat. No. 3,218,743 which shows a stand having a rotary holder which is adapted to be rotated for selectivity viewing photographs carried in a pack of sleeves mounted on the rotary holder.

U.S. Pat. No. Des. 235,238 discloses a stand having stationary holder loops for the photo sleeves. The arrangements shown in this design patent is of necessarily limited capacity.

The prior stands, exemplified by the before-mentioned U.S. patents, have been deficient in one or more respects, such as limited capacity, difficulties in loading or unloading the sleeves and/or photos, limitations upon viewing capability, susceptibility to damaging the photo sleeves due to inevitable strains during manipulation and storing them for long periods of time.

An important object of the present invention is to provide a large capacity display stand for sleeve carried graphic material such as photos, and the like, and having a new and improved economical structure adapted for easy and convenient loading and unloading, providing a novel viewing capability, and affording an efficient photo sleeve supporting and manipulative guiding arrangement.

In accordance with the principles of the present invention there is provided a large capacity display stand for graphic material carried by photo sleeves comprising a supporting frame, generally laterally extending arm structure carried by the frame for suspending a set of photo sleeves having opposite display faces, rest means projecting upwardly to a height above the arm structure; and means carried by the arm structure for guiding the sleeves manipulated from the suspended position into an upstanding position leaning against the rest, or for return to the suspended position.

Other objects, features and advantages of the invention will be readily apparent from the following description of certain representative embodiments thereof, taken in conjunction with the accompanying drawings, although variations and modifications may be effected without departing from the spirit and scope of the novel concepts embodied in the disclosure, and in which.

Figure 1:
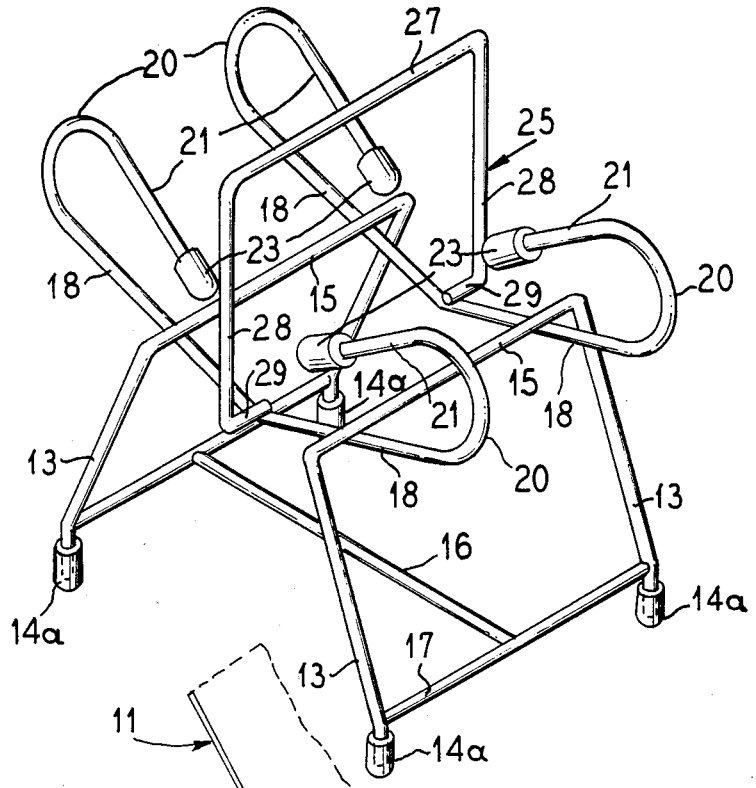
FIG. 1 is a perspective view of a preferred form of the display stand embodying the present invention.
Figure 2:
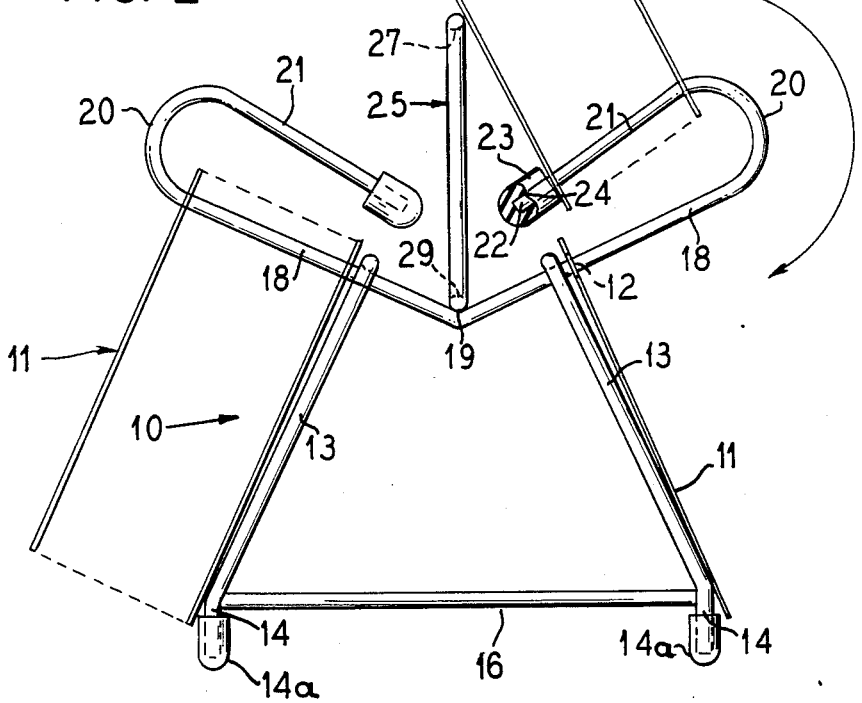
FIG. 2 is a side elevational view of the stand.

Referring to FIGS. 1 and 2, a large capacity display stand 10 for graphic material such as photos, and the like, is constructed and arranged to support two sets of up to 50 photo sleeves 11 each (100 pictures in each set) in such a manner that, as best seen in FIG. 2, photos in two of the sleeves can be viewed concurrently and in planes which are properly tilted from the vertical to facilitate viewing. The sleeves 11 may be of the conventional type having opposite transparent face panels so that two photos, or the like, or two sides of a card or other panel may be viewed selectively through the face panels. Each of the sleeves 11 has a header provided with spaced hanger holes 12.

In a preferred construction, the stand 10 is adapted to be formed from heavy wire stock and has stable supporting frame structure including four spaced generally upright legs 13 each of which has a supporting-surface-engageable and preferably supplied with a rubber foot 14 and its lower end tip 14*a*. At their upper ends, the legs 13 are connected by spaced pairs by means of respective cross bars 15 in a generally one piece inverted U-shaped arrangement. Lower portions of each pair of the legs 13 are desirably connected together at the upper ends of the feet 14 by means of respective horizontal stabilizing cross bars 17 which may be welded to the legs. For utmost stability, a central horizontal cross bar 16 is connected between the cross bars 17 as by means of welding.

At the upper part of the frame provided by the legs 13 and their cross bars, generally laterally extending arm structure is provided, in this instance comprising a respective pair of spaced arms 18, i.e. two sets of the arms, extending outwardly from the vertical center of the stand attached rigidly to each of the cross bars 15 and one set extending forwardly and another set extending rearwardly (depending on which set one faces in use of the stand). In a preferred construction, the arms 18 are attached as by means of welding to the undersides of the bars 15 and both sets of the arms are connected together at respective junctures 19 so that the arms 18 at both front and back of the stand are adapted to be formed in one piece modules. Each set of the arms 18 is adapted to support a set of up to 50 sleeves 11 by projection of the arms through the header holes 12 in the sleeves.

Means are provided on the arms 18 for receiving the sleeves 11 when mounting the same on the arms, for retaining a quantity of the sleeves 11 against unintentional displacement from the arms, and for guiding the sleeves 11 when manipulated from suspended position on the arms into upwardly extending position or return to suspended position. For this purpose each of the arms 18 is provided at its outer end with an integral loop yoke 20 carrying in superposed spaced relation to its arm an elongate inwardly extending bar or finger 21 having an inner free end terminal 22 which is spaced from all adjacent parts of the frame so as to facilitate mounting or removing of the photo sleeves 11 with respect to the fingers 21. Each of the terminals 22 has means for selectively retaining the photo sleeves against displacement from the terminals, i.e. stop shoulder means. To this end, each of the terminals 22 is adapted to carry a replaceable rubber retainer tip 23. The retainer tips 23 have respective sockets 24 slidably frictionally receptive of the terminals 22. Thus, when it is desired to load or unload the sleeves 11 for any pair of the arms 18, the tips 23 related to those arms are removed and the sleeves 11 either loaded or unloaded relative to the arms. After the sleeves 11 have been mounted, the tips 23 are replaced and serve as retainer stop shoulders against unintentional displacement of the sleeves when swung up onto the fingers 21.

Means are provided for resting the sleeves 11 in generally upright position when the sleeves are supported by the fingers 21. For this purpose a combination handle and rest 25 projects upwardly at the top of the stand 10 to a suitable height above the arms 18. In a desirable form, the rest 25 comprises a one piece generally inverted U-shaped module having a head cross bar 27 connecting in spaced parallel relation depending legs 28 preferably spaced apart substantially equal to the spacing between the frame legs 13 of each set. At their lower ends, the rest legs 28 have respective inwardly extending terminals 29 which are attached to the arms 18 at the junctures 19, that is, midway between the two oppositely extending sets of arms 18, as by means of welding. The arrangement is such that the sleeves 11 when supported by the fingers 21 and resting against the rest 25, and more particularly the head cross bar 27, and stopped by the shoulders provided by the tips 23, will be maintained at a sloping or tilted angle complementary to the slope or tilt of the sleeves 11 suspended from the arms 18 and backed against the legs 13, thus facilitating viewing of the photos or the like displayed at the exposed transparent faces of the upper and lower sleeves 11.

Where the stand 10 may have an overall height of about $6\frac{3}{8}$ inches, a side-to-side width of about 4 inches, an overall dimension of about $6\frac{1}{4}$ inches between the outer ends of the oppositely extending sleeve supporting arms 18, including the yokes 20, a height of the rest 25 above the inner sleeve supporting end portions of the fingers 21 of about $1\frac{1}{2}$ inches, and a capacity of about 50 of the double faced sleeves 11 on each pair of the arms 18, it will be apparent that each pair of the arms 18 is adapted to accommodate about 100 photos or the like, for a total capacity of about 200 photos or the like for the stand. A photo sleeve supporting tilt of about 25° from the vertical has been found desirable for the legs 13. The arms 18 should then correspondingly tilt upwardly at an angle of about 25° from the horizontal. The height of the head bar 27 may be related to the shoulders provided by the rubber tips 23 to engage the sleeve 11 resting thereagainst at about the vertical center of the sleeve where the sleeves are of about 4×5 inch size.

The most convenient way to view a series of photos is to shift the selected set of photo sleeves 11 from its suspended (storing) position into raised upstanding viewing position and resting against the rest 25 (FIG. 2). Then as each of the sleeves 11 is swung down (as indicated by directional arrow) from its raised position on the supporting fingers 21, into suspended position on the associated arms 18, both of the photos or the like exposed in the display faces of the upper and lower sleeves 11 may be concurrently viewed.

Figure 3:
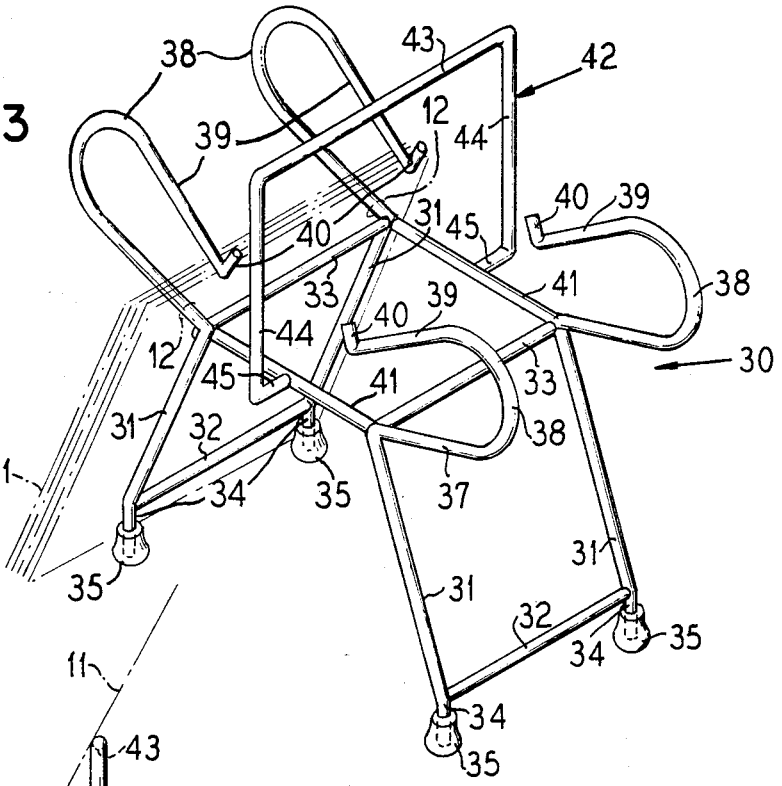
FIG. 3 is a perspective view of a modification.
Figure 4:
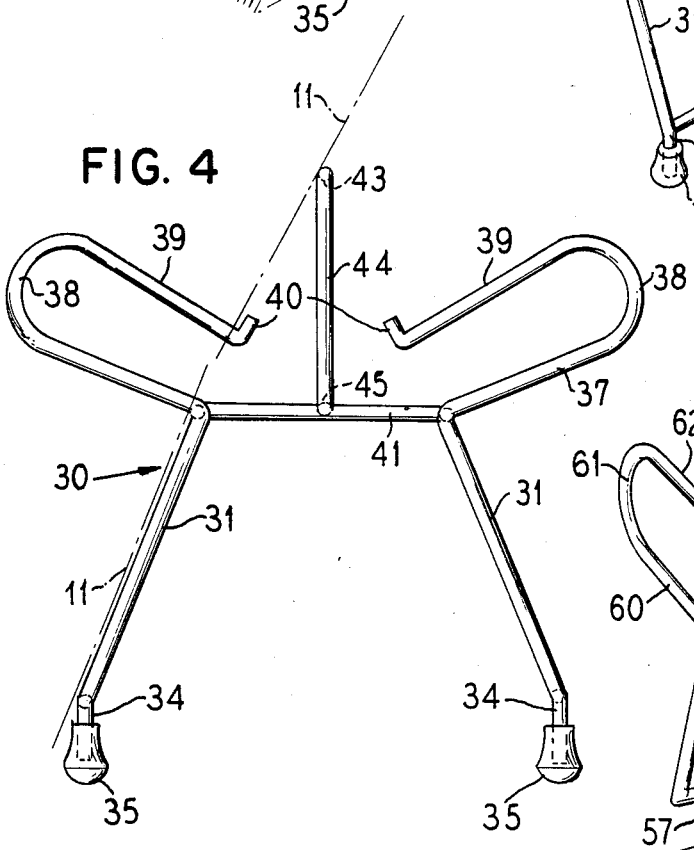
FIG. 4 is a side elevational view of the stand of FIG. 3.

In the modified stand 30 of FIGS. 3 and 4, the function with respect to the photo sleeves 11 is substantially the same as described for the stand 10, but some of the parts of the stand 30 are constructed differently. As shown, pairs of upwardly and inwardly sloping legs 31 are connected together in spaced parallel relation by respectively a lower cross bar 32 and an upper cross bar 33 and each of the legs has a downwardly extending lower terminal foot 34 equipped with a protective rubber tip 35. Each of the legs 31 has at its upper end integrally in one piece therewith an upwardly and laterally outwardly extending photo sleeve supporting arm 37 joined by a smoothly curved loop yoke 38 to a downwardly and inwardly sloping finger 39 which has an upwardly project shoulder terminal 40. Connecting the upper ends of one set of the legs 31 with the other set of the legs 31 are spaced connecting bars 41 welded to the legs 31 at substantially the same elevation as the cross bars 33. Attached to and supported by the connecting bars 41 is a combination handle and rest member 42 desirably formed in one piece and having a head bar 43, depending legs 44 and an inturned terminal 45 on each of the legs 44 secured as by welding to the mid point of the respective adjacent connecting bar 41. It will be observed that the upward and inward slope of the legs 31 and the upward and outward slope of the arms 37 as well as the radius of curvature of the yokes 38 and the inward and downward slope of the fingers 39 is substantially the same as described for the stand 10, so that the sleeves 11 are supported for display in substantially the same manner as described for the stand 10. In the stand 30, the shoulder stop terminals 40 avoid any need for removable rubber shoulder tips, unless for cosmetic purposes it is desired to apply such tips to the terminals 40.

Figure 5:
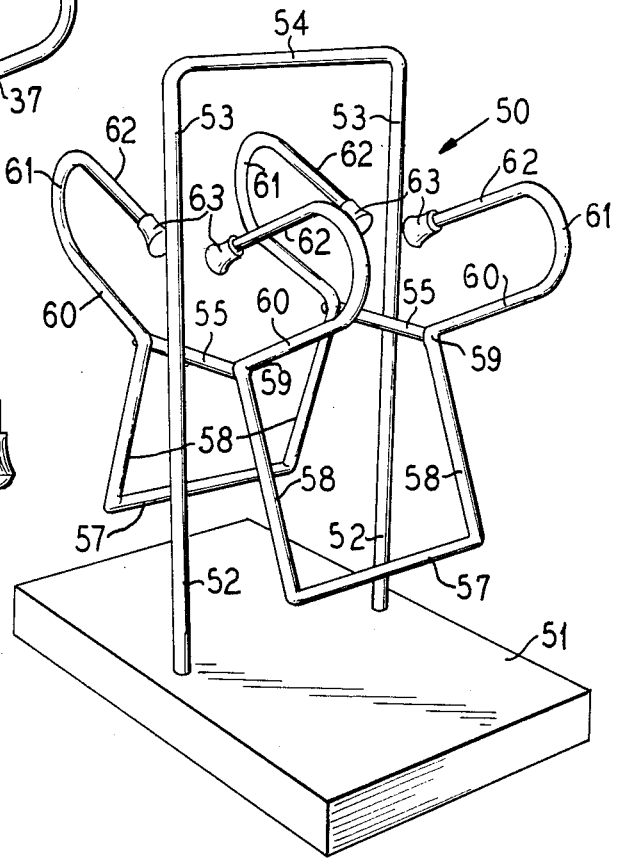
FIG. 5 is a perspective view of another modification.

Functioning of the modified stand 50 of FIG. 5 is substantially the same as described for the stands 10 and 30 but some structural differences are embodied in the stand 50 including a base panel 51 for supporting the stand. In this instance the base panel provides the bottom of the frame of the stand in cooperation with spaced vertical legs 52 secured to the base panel 51 and provided as integral extensions from upwardly extending rest legs 53 connected together in spaced relation by an integral head bar 54 which may serve as a convenient handle for carrying the stand. At the upper ends of the frame legs 52, and at juncture thereof with the rest legs 53, is supported photo sleeve carrying means including elongate parallel supporting cross bars 55 extending at a common elevation parallel to a longitudinal axis through the unit and fixedly attached intermediate their ends to the legs 52, 53.

Fixedly attached to the opposite ends of the supporting cross bars 55 are structures for not only supporting photo sleeves in suspended relation but also in upturned relation for leaning against the rest 53, 54. In a preferred construction, the photo sleeve supporting means comprises a pair of identical, desirably one piece wire-form members or modules each of which comprises a lower cross bar 57 attached at each opposite end to a generally upwardly and inwardly slanting leg 58 having a preferably right angular juncture 59 with a generally upwardly and outwardly slanting hanger arm 60, with fixation to the bars 55 at the junctures 59. Each of the arms 60 has at its outer end a generally upwardly and reverse bend transition guide yoke 61 which joins a generally inwardly and downwardly slanting bar or finger 62 for supporting the photo sleeves carried by the unit in an upstanding position for resting against the rest 53, 54. Replaceable stop shoulder rubber tips 63 are adapted to be applied to free terminal ends of the bars 62. Functioning of the display stand 50 in supporting and display modes in respect to photo sleeves is substantially the same as described in connection with the form of FIG. 1.

From the foregoing it will be apparent that the present invention provides a new and improved display stand having a large capacity arrangement for carrying for display two sets of up to 50 sleeves each containing 100 pictures or similar graphics in a manner for efficiently displaying sleeve-carried graphic material on two sleeves at the same time and wherein one of the sleeves is in a hanging position and the other of the sleeves is in an upstanding position. Respective quantities or sets of the graphic material containing sleeves can be quickly and easily loaded onto or removed from the stand. The sleeves are positively supported and guided for easy manipulation from one position to the other. The manner in which the sleeves are supported and guided assures freedom from damaging stresses to the punched headers of the sleeves during manipulation because of the smooth and easy transitional guidance from and between the suspended and upstanding positions. For maximum display efficiency, the display faces of the sleeves are maintained at convenient slanting angles for comfortable line of vision by persons viewing the same.

Not the least of the many attributes of the invention is that the structure of the stands is adapted for low cost mass production.

It will be understood that variations and modifications may be effected without departing from the spirit and scope of the novel concepts of this invention.

I claim as my invention:

1. A large capacity display stand for graphic material carried by photo sleeves which have header holes therethrough, comprising:

a frame carrying horizontally spaced arm structures each having elongate vertically spaced superposed first and second parts of cross section to fit through said header holes;

sleeve guiding means connecting said parts;

each of said first parts having an end remote from said guiding means and fixedly connected to said frame;

each of said second parts having a free end remote from said connecting means and adjacent to but spaced from said frame so as to facilitate mounting or removing of the photo sleeves relative to said second parts;

stop shoulder means on said free ends of said second parts for retaining the photo sleeves against unintended displacement therefrom;

the photo sleeves being moveable to and from said first and second parts by way of said guiding means for, on one of said parts, being suported in a suspended position and, on the other of said parts, being supported in a generally upstanding position; and means for resting of the sleeves thereagainst in said generally upstanding position of the sleeves.

2. A display stand according to claim 1, wherein said frame carries two sets of said arm structures, one set of said arm structures being located at one side of said resting means, and the other set of said arm structures being located at the opposite side of said resting means.

3. A display stand according to claim 1, wherein said resting means maintains the upstanding sleeves at a convenient slanting angle for viewing, and means below said arm structures for maintaining the suspended sleeves at a convenient slanted angle for viewing.

4. A display stand according to claim 1, wherein said stop shoulder means comprise replaceable rubber tips.

5. A display stand according to claim 1, wherein said stop shoulder means comprise angular shoulder terminals on said second parts.

6. A display stand according to claim 1, wherein said frame comprises upstanding legs, and said arm structures and resting means are supported at the upper ends of said legs.

7. A display stand according to claim 1, in which said frame, arm structures, resting means and guiding means comprise wireform construction.

8. A display stand according to claim 1, wherein said resting means comprises a handle by which the stand is adapted to be carried.

9. A display stand according to claim 8, wherein said handle comprises an upstanding inverted U-shaped structure.

10. A display stand according to claim 1, wherein said frame comprises upstanding legs to which said arm structures and said resting means are fixedly attached.

11. A display stand according to claim 1, wherein said frame comprises upstanding legs supporting said resting means at their upper ends in the form of a generally inverted U-shaped handle structure.

12. A display stand according to claim 11, wherein said legs also carry horizontal support bars, and said arm structures being carried by said support bars.

13. A large capacity display stand for graphic material carried by photo sleeves having spaced header holes, comprising:

a wire form frame having first rigid elongated means for extending through said header holes and supporting a pack of photo sleeves in depending position, and second rigid elongated means for extending through said header holes and supporting the pack of photo sleeves in upstanding position;

means connecting said first and second means for guiding the photo sleeves from either of said elongated means to the other of said elongated means;

an upstanding inverted U-shaped rigidly positioned manually graspable handle arranged for supporting the sleeves in said upstanding position;

one of said elongated means having free ends adjacently spaced from said frame to facilitate loading the photo sleeves thereon and for unloading the photo sleeves therefrom; and means for selectively retaining the photo sleeves against displacement from said free ends.

14. A display stand according to claim 13, wherein said frame carries two sets of said sleeve supporting means, one set of said sleeve supporting means being located at one side of said handle and the other set of said sleeve supporting means being located at the opposite side of said handle.

15. A large capacity display stand for graphic material carried by photo sleeves mounted on said stand, and comprising:

a supporting frame;

horizontally spaced parallel arms slanting generally upwardly from said supporting frame and adapted to extend through header holes in depending photo sleeves;

said arms having respective smoothly upwardly curved yokes remote from the frame and leading onto respective supporting fingers overlying the arms in spaced relation and slanting generally downwardly toward the frame so that the photo sleeves can be shifted from depending relation on said arms into generally upstanding relation on said fingers;

said fingers having free ends spaced from said frame such that there is a space between said frame and said free ends to facilitate loading photo sleeves onto said fingers by engaging said fingers through said header holes or removing photo sleeves from said fingers;

stop shoulder means on said free ends of said fingers for retaining the sleeves against unintended displacement from the fingers; and upstanding means on said frame against which the photo sleeves can rest when the photo sleeves are in generally upstanding relation on said fingers.

16. A display stand according to claim 15, wherein said frame carries two sets of said arms and fingers, one set being located at one side of said upstanding means and the other set being located at the opposite side of said upstanding means.

17. A display stand according to claim 15, including means for maintaining said sleeves tilted for convenient viewing in both the depending relation and the upstanding relation.

18. A display stand according to claim 15, wherein said rest means for supporting the sleeves in upstanding position comprising a handle for carrying the stand.

19. A display stand according to claim 15, wherein all parts of the stand are rigidly connected wire form parts so that the stand is free from any relatively moveable parts in operation.

* * * * *